US005921290A

United States Patent [19]

Dyer et al.

[11] Patent Number: 5,921,290

[45] Date of Patent: Jul. 13, 1999

[54] HANDHELD TENSIONING AND CUTOFF TOOL

[75] Inventors: Edward Paul Dyer, Germantown; William Karl Lueschen, Cedarburg, both of Wis.

[73] Assignee: Tyton Hellermann Corporation, Milwaukee, Wis.

[21] Appl. No.: 08/838,524

[22] Filed: Apr. 8, 1997

[51] Int. Cl.[6] ..... B21F 09/02

[52] U.S. Cl. ..... 140/123.6; 140/93.2

[58] Field of Search ..... 140/93.2, 93.4, 140/123.6, 150, 152; 53/592

[56] References Cited

U.S. PATENT DOCUMENTS 3,931,838 1/1976 Bakermans ..... 140/123.6

4,449,429 5/1984 Sauer et al. ..... 140/93.2

5,137,060 8/1992 Wolcott ..... 140/123.6

*Primary Examiner*—Lowell A. Larson

*Attorney, Agent, or Firm*—Ryan Kromholz & Manion, S.C.

[57] ABSTRACT

A handheld tool for installing flexible metal ties includes a gun-shaped housing having a grip and a barrel portion. When a trigger adjacent the grip is squeezed, a tensioning and cutoff mechanism in the barrel tensions the tie and cuts it off after a predetermined tension is achieved. In order to achieve the substantially higher tensions that are desirable in metal, rather than plastic, ties, the barrel portion of the housing is reinforced with a member that surrounds the forward portion of the barrel portion. The reinforcing member is preferably formed of a rigid member and stiffens the barrel portion of the housing to enable it to resist the tensioning forces applied to the metal tie by the tensioning and cutoff mechanism.

8 Claims, 4 Drawing Sheets

HANDHELD TENSIONING AND CUTOFF TOOL

BACKGROUND OF THE INVENTION

This invention relates generally to tools for installing cable ties and, more particularly, to handheld tools that apply tension to such ties and cut off the excess portion of such ties while holding the tie under tension. More particularly, this invention relates to such handheld tools that are capable of generating the higher tensions that are needed to tension and cut off metal, rather than plastic, ties.

Flexible cable ties are well known items. Such ties are used to secure wires, cables, tubing and similar items into tight, neat bundles. Typically, flexible cable ties include a head portion and a tie tail portion extending from the head. In use, the tie tail is looped around the items to be secured and then inserted through the head. A locking or ratcheting mechanism in the head holds the tie tail in the head and secures the tie around the bundle. Preferably, the tie tail is pulled through the head under tension to draw the items to be secured into a tight bundle. Thereafter, the excess portion of the tie tail is clipped off near the head.

Many flexible ties are economically molded of flexible plastic. For some applications, however, plastic has insufficient strength or other drawbacks, and metal ties are used. Metal ties include a flat strap portion and a locking head portion, each of which is made of a strong, durable metal such as stainless steel. As a rule, metal ties are significantly stronger than plastic ties of the same size and are typically pulled to much higher tensions than plastic ties when they are installed.

A variety of tools have been developed to enable workers to install flexible cable ties with speed, uniformity and economy. Generally, such tools function to grip the tie tail portion of the tie after the tie has been looped around the items to be bundled. The tool pulls the tie tail until a predetermined desired tension is achieved after which the tool cuts off the excess portion of the tie tail closely adjacent the head. Such tools greatly simplify the task of properly installing cable ties.

Various handheld tools have been developed to assist in the installation of flexible ties. In one well known form of handheld tool, the tool comprises a pistol or gun-like device having a movable trigger or lever that is squeezed by the operator to pull on the tie tail and thereby tension the tie. The operator continues squeezing the trigger until a predetermined tension is achieved after which a cutting blade adjacent the nose of the tool snaps upwardly to clip off the excess portion of the tie tail. A knob at the rear of the tool allows the worker to adjust or set the tension at which cutoff occurs. Examples of such manually operated handheld tools are shown in the inventors' U.S. Pat. No. 4,997,011, issued Mar. 5, 1991, and U.S. Pat. No. 4,793,385 issued Dec. 27, 1998, commonly owned by the assignee hereof.

Prior handheld tie installation tools have been intended primarily for use with plastic ties or smaller metal ties that are not tensioned to the same high tensions desirable with larger metal ties. Accordingly, such prior tools are not optimally suited for tensioning and cutting off metal ties over the full range of tensions such ties can provide.

SUMMARY OF THE INVENTION

The invention provides a tool for installing metal ties having a pistol-shaped housing including a grip, a barrel portion and an elongate trigger extending downwardly from the barrel portion forwardly of the grip and displaceable toward and away from the grip. A tensioning mechanism in the barrel portion is operable to engage the tie and apply tension to the tie in response to movement of the trigger toward the grip. A cutoff mechanism in the barrel portion is operable to cut-off the tie when tension applied by the tensioning mechanism reaches a predetermined threshold. A reinforcing member surrounds at least a portion of the barrel portion to stiffen the barrel portion of the housing and resist compressive forces developed in the barrel portion as the tensioning mechanism tensions the tie.

The invention also provides a nose guard assembly for reinforcing a tie tensioning and cutoff tool comprising a rigid member shaped and dimensioned to engage and support the portion of the tie tensioning and cutoff tool operable to develop tension in the tie.

It is an object of the invention to provide a new and improved handheld tool for tensioning and cutting off flexible ties.

It is a further object of the invention to provide a handheld tie tensioning and cutoff tool that is well suited to use with metal ties.

It is a further object of the invention to provide a new and improved handheld tool for tensioning and cutting off flexible cable ties that is compact, lightweight and easy to use.

It is a further object of the invention to provide a new and improved handheld tool for tensioning and cutting off flexible cable ties that is operated using an external source of power.

It is a further object of the invention to provide a new and improved handheld tool for tensioning and cutting off flexible cable ties that is capable of achieving high cable tie tension using a small, lightweight tool.

It is a further object of the invention to provide a new and improved handheld tool for tensioning and cutting off flexible cable ties that avoids operator fatigue and/or repetitive stress conditions.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT THE TENSIONING AND CUTOFF TOOL SYSTEM

Figure 1:
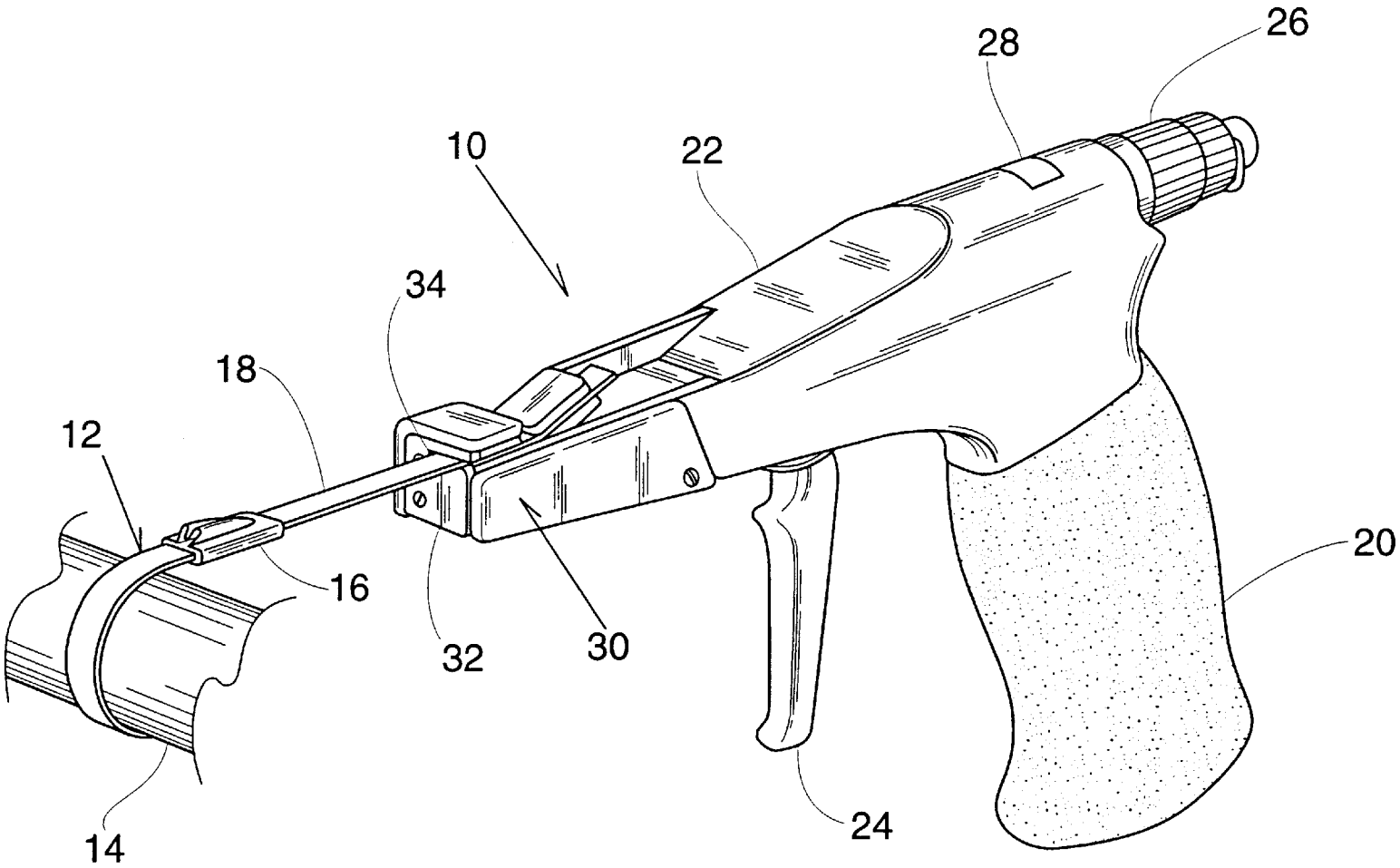
FIG. 1 is a perspective view of a handheld tensioning and cutoff tool embodying various features of the invention.

A handheld tensioning and cutoff tool 10 embodying various features of the invention is shown generally in FIGS.

1 and 2. The tool 10 is typically used to install flexible ties 12 around wire or cable bundles 14 and is particularly well suited to installing metal ties under considerable tension. As illustrated, the tie 12 includes a head portion 16 and a tie tail portion 18. The tool 10 grips the tie tail portion 18 of the tie 12 and pulls it through the head 16 until a predetermined tension is achieved. The tool 10 then automatically cuts off the excess tail portion 18 closely adjacent the head 16.

Various types of handheld tie installation tools have previously been developed. Such tools rely on muscle power for operation and typically require the operator to squeeze a trigger or lever in order to tension the tie and cut off the excess tail portion. In the case of ties formed of injection molded plastic, relatively low installation tensions (e.g., 30 pounds) are desirable. In the case of metal ties, however, significantly higher installation tensions (e.g., 100 pounds) are desirable. Accordingly, a tool used to install metal ties needs to be capable of developing the higher tensions required by such ties. Additionally, because a metal tie tail is harder to cut than a plastic one, more cutting force needs to be developed by the tool in installing a metal tie than in installing a plastic tie.

The handheld tool 10 is optimized for use with metal, and, in particular, stainless steel, ties. In the illustrated embodiment, the tool 10 is capable of developing tie tensions up to approximately 120 pounds and is capable of cutting stainless steel tie tails up to approximately one-half inch wide and approximately 0.010 to 0.020 inches thick.

The handheld tool 10 includes a generally gun or pistol shaped housing having a handle or grip portion 20, a barrel portion 22 and a trigger 24. The trigger 24 is located forwardly of the grip 20 and under the barrel portion 22 where it falls naturally under the fingers of the operator. The trigger 24 is movable from an initial position spaced away from the grip 20 to a final position adjacent the grip 20.

The tie 12 is tensioned by means of a tie gripping and tensioning mechanism located at the forward end of the barrel portion 22 of the tool 10. The tie gripping and tensioning mechanism grips the tail portion 18 of the tie 12 and pulls it rearwardly as the trigger 24 is moved toward the final position. When the trigger 24 is released, it springs forwardly to the initial position. At the same time, the tie gripping a tensioning mechanism releases the tie tail 18 and moves forwardly relative to the tie tail 18. As the trigger 24 is once again squeezed, the tie gripping and tensioning mechanism once again grips the tie tail 18 and draws it back. The process is repeated until a sufficient, predetermined tension is achieved in the tie 12.

When the predetermined tension is reached, a cutoff mechanism, also located at the forward end of the barrel portion 22, cuts off the tie tail 18 closely adjacent the head 16. The predetermined tension is set or adjusted by means of an adjustment knob 26 at the rear of the tool 10. The relative tension thus set by the knob is indicated by means of an indicator visible through a window 28 at the top of the tool 10.

In accordance with one aspect of the invention, the tool 10 is optimized for use with metal, and in particular, stainless steel, ties. Such ties are typically installed under considerable tension, which often greatly exceeds the tensions encountered with plastic ties. The tool 10, therefore, must be capable of generating and withstanding the greater tensions needed with metal ties. To this end, the tool 10 is provided with a reinforcing member in the form of a nose guard assembly 30 that surrounds, stiffens and strengthens the forward end of the tool 10. The nose guard assembly 30 helps the forward end of the tool 10 resist the compressive forces developed in the barrel portion 22 as the tensioning mechanism tensions the tie 12.

The nose guard assembly 30 includes a metallic outer nose piece 32 that defines a blunt, substantially vertical planar face adapted to butt up against the head 16 of the tie 12 when the tie is tensioned. The outer nose piece 32 includes a horizontal slot 34 dimensioned to receive the tie tail 18 of the cable tie 12. As best seen in FIG. 1, the slot 34 is open toward the left hand side of the tool 10 so that the tie tail 18 can be inserted into the tool 10 from the side. A metallic inner nose piece 36 is positioned adjacent and behind the outer nose piece 32. A nose guide block 38 integrally formed at the forwardmost end of the housing is positioned immediately behind the inner nose piece 36 and defines a lower surface for supporting the underside of the tie tail 18.

THE TIE GRIPPING AND TENSIONING MECHANISM

Figures 2, 7:
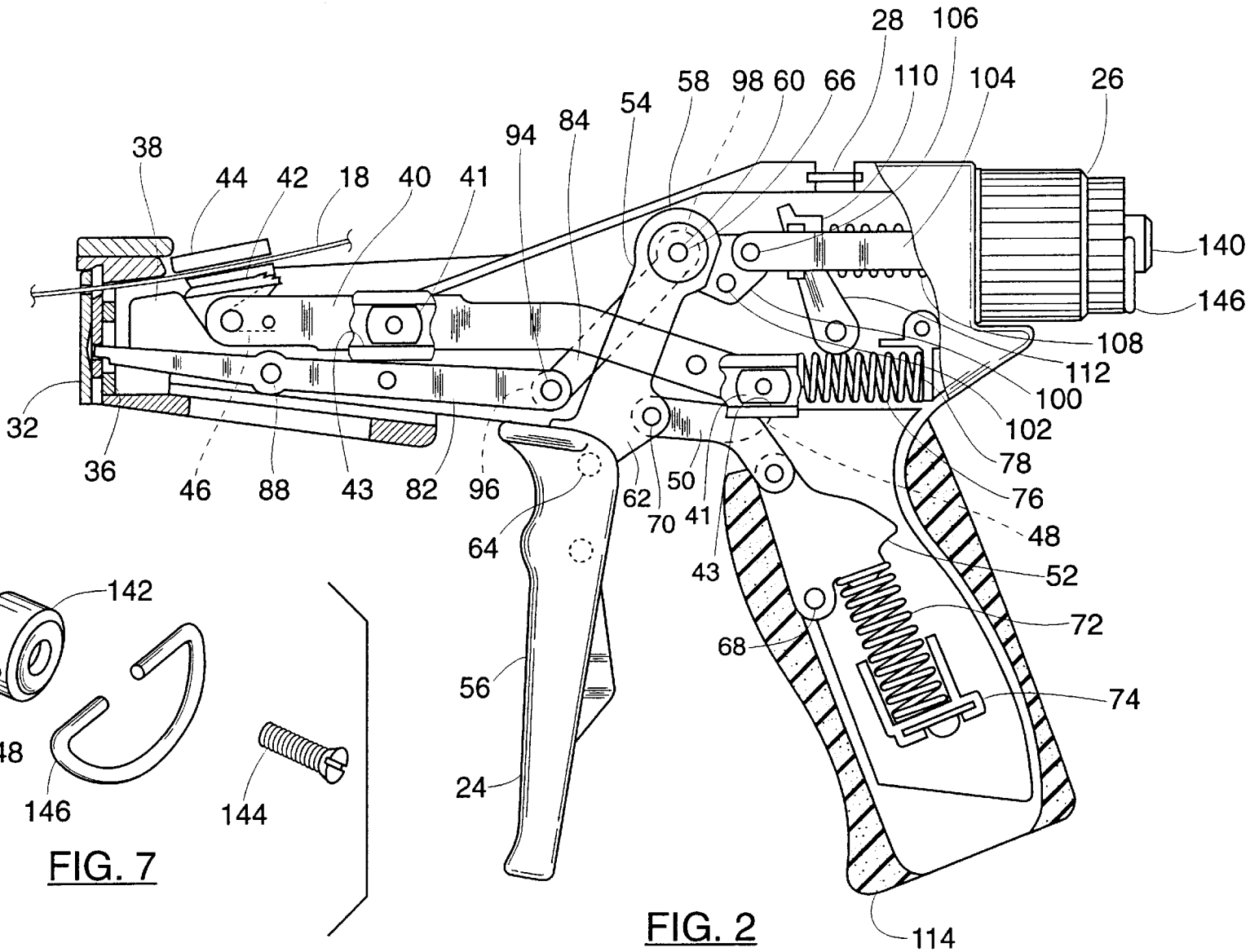
FIG. 2 is a side sectional view of the tool shown in FIG. 1 showing the internal structure of the tool.
FIG. 7 is an exploded perspective view of a hook assembly included in the tool.
Figure 4:
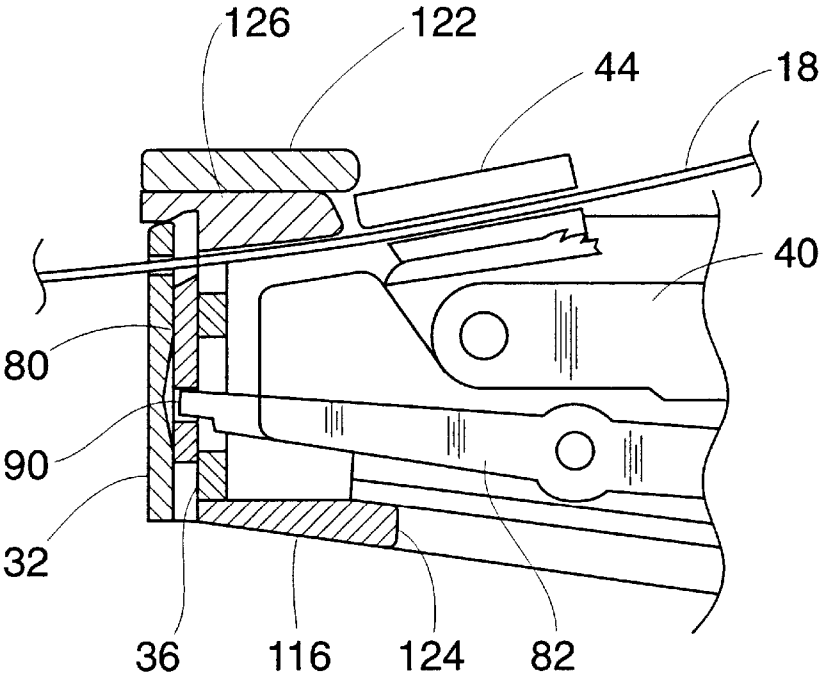
FIG. 4 is a fragmentary side sectional view of the front end of the tool.
Figure 3:
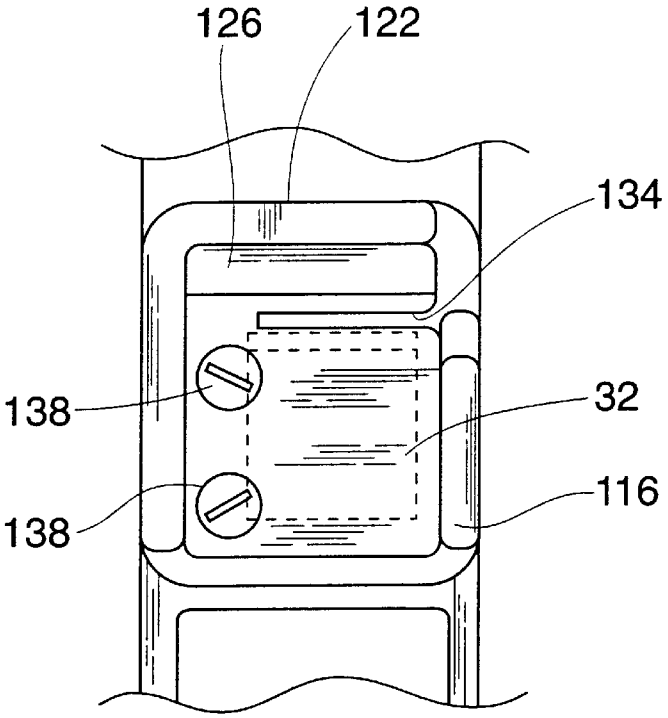
FIG. 3 is a front end view of the tensioning and cutoff tool.
Figures 5, 6:
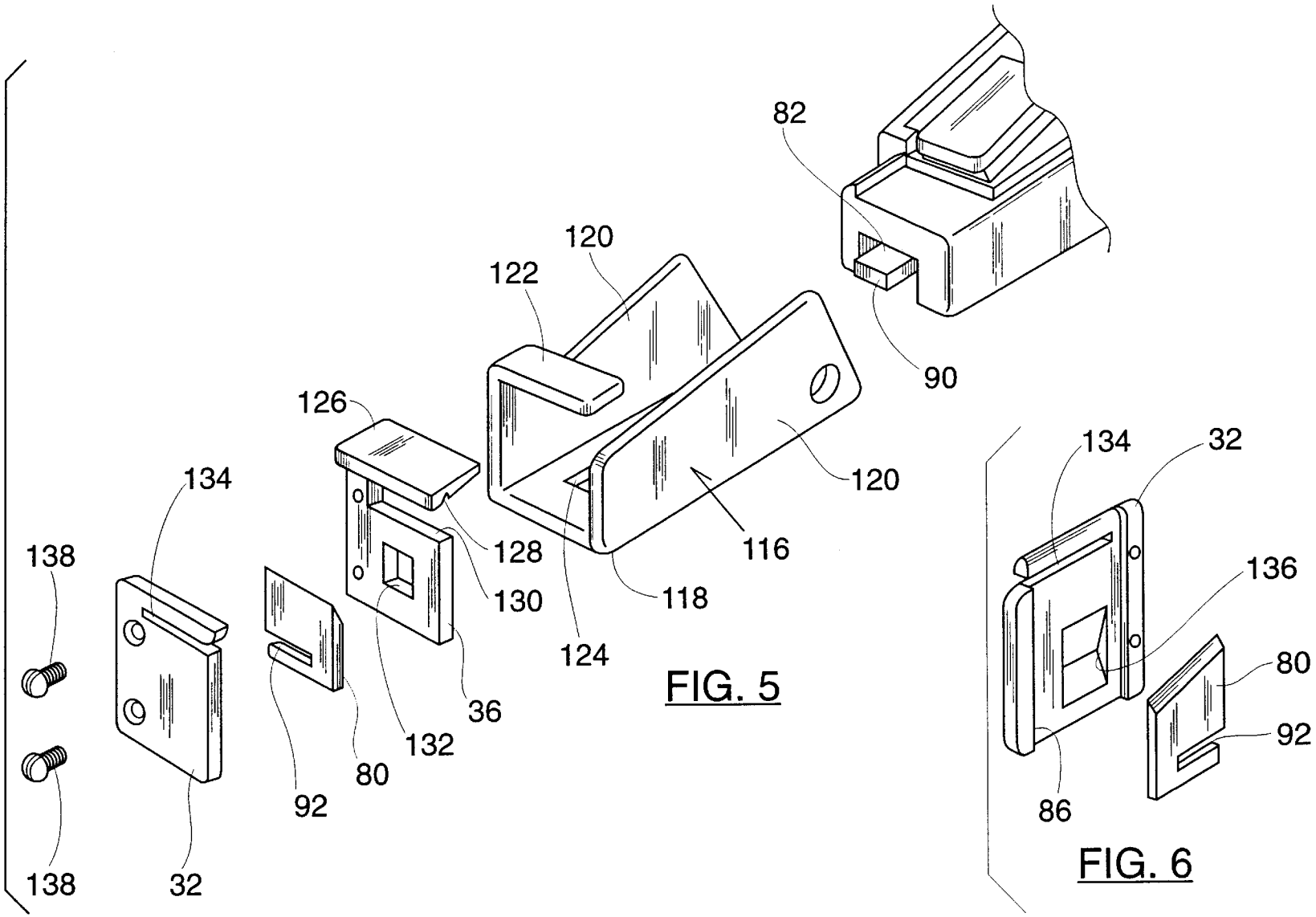
FIG. 5 is an exploded perspective view of the front end of the tool showing the reinforcing components thereof.
FIG. 6 is a perspective view of a nosepiece and cutoff blade incorporated into the tool.

The construction and operation of the tool 10 can best be understood by reference to FIG. 2. As illustrated, the tie gripping and tensioning mechanism is internally mounted within the barrel portion 22 and includes a pair of spaced, parallel pawl links 40 mounted for horizontal, linear reciprocating movement relative to the housing. The pawl links 40 are supported for linear sliding movement within the housing by means of a pair of slider blocks 41 received within rectangular-sectioned channels 43 formed in the interior wall of the housing. Each slider block 41 includes a pair of spaced, parallel faces that engage the walls of the channels 43 as shown. The tie tail 18 is gripped by means of a tie gripping pawl 42 carried at the forwardmost ends of the pawl links 40. The gripping pawl 42 is pivotally attached to the pawl links 40 and is upwardly pivotable toward a backing plate 44, also carried at the ends of the pawl links 40. Preferably, the backing plate 44 is integrally formed at the forward end of one of the pawl links 40, and the gripping pawl 42 is rotatably biased toward the backing plate 44 by means of a torsion spring 46 so that a cable tie tail 18 inserted therebetween will be engaged by and between those elements. Preferably, the upper surface of the gripping pawl is provided with teeth or serrations that engage the tie tail 18 and improve the grip of the gripping pawl on the tie tail 18. As illustrated, the inner edge of the nose guide block 38 is beveled to form a ramped surface. This surface engages the gripping pawl 42 when the pawl links 40 are at the leftmost or initial position as viewed in FIG. 2. Such engagement pivots the gripping pawl 42 away from the backing plate 44 to facilitate insertion of the tie tail 18 into the tool 10.

When the pawl links 40 move horizontally toward the right as viewed in FIG. 2, the tie tail 18 is pinched between the gripping pawl 42 and the backing plate 44. The tie tail 18 is thus pulled along with the pawl links 40. It will be appreciated that, as the pawl links 40 move to the right as viewed in FIG. 2, the gripping pawl 42 grips the tie tail 18 to pull the tie tail 18 and thereby tension the tie 12.

When the pawl links 40 are reciprocated to the left as viewed in FIG. 2, the gripping pawl 42 releases its grip on the tie tail 18, thereby permitting the pawl links 40 to return to their initial position without simultaneously moving the tie tail 18.

Referring further to FIGS. 2–6, the pawl links 40 are reciprocated within the housing by means of an actuating structure including the trigger 24, an upper short link 48, a pair of lower short links 50 and a handle link 52.

The trigger includes an elongate, rigid trigger member 54 that extends upwardly into the barrel portion 22 of the housing. Preferably, a boot 56 formed of plastic or similar material and shaped to engage the tool operator's hand is joined to the lower end of the trigger member 54. The upper end of the trigger member 54 terminates within the barrel portion 22 adjacent the upper end thereof. The trigger member 54 includes two substantially parallel, spaced arms 58 at its upper end. Each of the arms includes a circular aperture. A pair of circular trigger bearings dimensioned to be closely received in the apertures, are mounted to the interior of the housing and serve to pivotally mount the trigger member within the housing for movement around a substantially horizontal pivot axis 60. When thus mounted, the trigger 24 is movable from a forward or initial position shown in FIG. 2 to a rearward or final position closely adjacent the grip 20.

An actuating link 62 extends upwardly into the barrel portion 22 of the housing alongside the trigger member 54 between the arms 58. The lower end of the actuating link 62 is pivotally joined to the trigger member 54 for pivoting movement around a substantially horizontal pivot axis 64. The upper end of the actuating link 62 supports a horizontally disposed pivot pin 66 that can be concentrically aligned with the circular apertures in the upper ends of the trigger member arms 58.

The handle link 52 comprises a single, rigid, elongate plate-like member having a lower end pivotally mounted to the grip portion 20 of the housing for pivoting movement around a substantially horizontal pivot axis 68. The upper end of the handle link 52 extends upwardly and forwardly toward the rear ends of the pawl links 40.

The upper short link 48 and the lower short links 50 each comprise rigid, elongate substantially parallel members that are of arcuate or dog-leg form. The upper short link 48 and the lower short links 50 are each pivotally joined at their forward ends to the actuating link 62 at a point 70 between its ends. The lower short links 50 are pivotally joined at their rear ends to the upper end of the handle link 52. The rear end of the upper short link 48 is pivotally joined to the rear ends of the pawl links 40.

A lower return spring 72 confined between the handle link 52 and a support ledge 74 formed in the interior of the grip 20 biases the handle link for rotation around the pivot axis 68 in a counterclockwise direction as viewed in FIG. 2. An upper return spring 76 confined between the rear interior wall 78 of the barrel 22 and the rear ends of the pawl links 40 biases the pawl links 40 for forward movement relative to the housing. Together, the upper return spring 76 and the lower return spring 72 bias the actuating link 62, the trigger 24 and the pawl links 40 to the forward or initial positions shown in FIG. 2.

The Cutoff Mechanism

The cutoff mechanism comprises a sharpened blade 80, a blade link 82 and a cutoff link 84. The blade 80 is located at the front of the barrel 22 between the outer nose piece 32 and the inner nose piece 36. The blade 80 is confined within a rectangularly sectioned channel 86 (FIG. 6) formed in the inner face of the outer nose piece 32. When the blade is reciprocated upwardly, it cuts off the tie tail 18 immediately behind the outer nose piece 32 and closely adjacent the tie head 16.

The blade 80 is reciprocated vertically by means of the blade link 82. The blade link 82 comprises an elongate, rigid lever that extends along the length of the barrel portion 22 below the pawl links 40. The blade link 82 is pivotally mounted to the housing for pivoting movement around a substantially horizontal pivot axis 88. The forwardmost end of the blade link 82 tapers and terminates in a tab (FIG. 6) that is received in a complementary slot 92 formed in the blade 80. As the blade link 82 pivots around the axis 88, the blade 80 is moved up or down.

The rear end of the blade link 82 is pivotally joined to one end of the cutoff link 84 for pivoting movement around a substantially horizontal pivot axis 94. The cutoff link 82 comprises a rigid, elongate member having a first pair of laterally spaced tabs or ears 96 at its lower end and a second pair of laterally spaced tabs or ears 98 at its upper end. The lower ears 96 straddle the rear end of the blade link 82 to establish the pivotal connection thereto. The cutoff link 84 extends upwardly and rearwardly away from the blade link 82 so that the upper ears 98 are concentrically aligned with the upper ends of the actuating link 62 and the pivot axis 60.

A cutoff cam 100 is pivotally mounted in the housing for pivoting movement around a substantially horizontal pivot axis 102 and includes a notch in its upper surface. The pivot pin 66 at the upper end of the actuating link 62 ordinarily rests in the notch. The cutoff cam 100 is preferably formed of an integral U-shaped piece of durable metal having a ramped forward end ahead of the notch.

A tension control mechanism pivotally connected to the rear of the cutoff cam 100 biases the cam for rotation around the pivot axis 102 in the clockwise direction as viewed in FIG. 2. Accordingly, the cutoff cam 100 ordinarily assumes the rotational position shown in FIG. 2. In this position, the cutoff cam 100 keeps the pivot pin 66 concentrically aligned with the pivot axis 60 established by the trigger member 54 and the trigger bearings. With the pivot pin 66 so located, the cutoff link 84 pulls the rear end of the blade link 82 upwardly. This causes the blade link 82 to pivot around the pivot axis 88 in the counterclockwise direction as viewed in FIG. 2 thereby lowering the blade 80. If the cutoff cam 100 is permitted to rotate in the counterclockwise direction around the pivot axis 102, the pivot pin 66 is able to slide forwardly out of the notch in the cutoff cam 100. This causes the cutoff link 84 to push the rear end of the blade link 82 down. This, in turn, pivots the blade link 82 in the clockwise direction as viewed in FIG. 2 thereby raising the blade 80. The tie tail 18 is snipped off as the blade 80 is raised.

The Tension Control Mechanism

The tension control mechanism functions to provide a controlled tension to the rear of the cutoff cam 100. This, in turn, determines the point at which the cutoff cam 100 pivots to actuate the cutoff mechanism and thereby cutoff the tie tail 18.

The tension control mechanism includes a U-bracket 104 positioned horizontally, and slidably movable, within the housing at the rear of the barrel portion 22. The forward ends of the U-bracket are pivotally coupled to the rear end of the cutoff cam 100 by means of a tension pin 106 extending through the forward ends of the U-bracket 104 and through an elongated slot formed in the cutoff cam 100. The rearward end of the U-bracket 104 is biased toward the rear of the housing by means of a tension spring 108. The tension spring 108 is confined between a fixed cam and a tension nut 110 that is slidably movable along the arms of the U-bracket 104. A threaded tension rod coupled to the tension adjustment knob 26 threadedly engages the tension nut 110. As the adjustment knob is turned, the threaded rod either draws the tension nut 110 closer to the fixed cam or drives the tension nut farther from the fixed cam depending upon the direction in which the knob 26 is turned. Accordingly, the tension applied by the U-bracket 104 to the cutoff cam 100 is increased as the knob 26 is turned so as to compress the tension spring 108 and is decreased as the knob 26 is turned to decompress the tension spring 108.

Preferably, the U-bracket 104 is coupled to an indicator through a linkage 112 so that the indicator moves under the window 28 as the tension is adjusted. Similarly, the knob 26 is preferably provided with a "quick adjust" feature of known construction that enables the tension to be set quickly and conveniently to "Low," "Medium" and "High" tension settings. Various forms of such mechanisms are shown, for example, in the inventors' U.S. Pat. No. 4,997,011 and U.S. Pat. No. 4,793,385, the specifications of which are incorporated by reference herein.

Operation

FIG. 2 shows the tool 10 in its initial, unactuated state when the tie tail 18 is first inserted into the slot. In this condition, the trigger 24 is fully forward and away from the grip. The cutoff cam 100 is pivoted in its full clockwise position around the pivot axis 102 under a predetermined tension developed and applied by the tension control mechanism. This draws the pivot pin 66 into the notch and aligns the pivot pin 66, the upper end of the actuating link 62 and the upper ends 98 of the cutoff link 84 with the pivot axis 60. The upper and lower return springs 76 and 74 pivot the handle link 52 to its full counterclockwise position around the pivot axis 68 to push the pawl links 40 forward toward the inner and outer nose pieces 32 and 36. The tie gripping pawl 42 engages the beveled edge of the nose guide block 38, which pivots the pawl 42 away from the tie tail 18.

Cable tie tensioning begins when the trigger 24 is squeezed toward the grip 20. As the trigger 24 begins moving, the lower short links 50 pivot the handle link 52 in the clockwise direction around the pivot axis 68 and against the force of the lower return spring 72. At the same time, the upper short link 48 draws the pawl links 40 away from the inner and outer nose pieces 72 and 36. The pawl links 40 move back in a straight line as the handle link 52 pivots, and the upper return spring 78 compresses as the handle link 52 pivots and the pawl links 40 are drawn back.

As the pawl links 40 begin to move back and the pawl 42 disengages from the beveled edge of the nose guide block 38, the pawl 42 pivots upwardly in response to its spring bias and traps the tie tail 18 between itself and the backing plate 44. This grips the tie tail 18 and pulls the tie tail 18 back along with the pawl 42 and pawl links 40. This has the further effect of pulling the tie tail 18 through the head 16 of the tie 12 to tighten the tie around the wires 14 (FIG. 1).

When the tie 12 is initially installed and the tie tail 18 is first pulled back, it generates little resistance to being pulled. As the tie draws up against the wires 14, however, the tie tail 18 resists being pulled. This resistance is felt by the pawl links 40 and is transferred, through the upper short link 48, to the actuating link 62. It will be understood that the upper short link 48 is not connected directly to the trigger member 54 but, rather, is coupled to the trigger member 54 through the actuating link 62. For so long as the tie tail 18 does not resist being pulled by the pawl 42 and pawl links 40, little resistance is felt by the handle link 52 as it is pushed back by the lower short links 50. However, as the tie tail 18 begins to resist being pulled, the resistance felt by the pawl links 40 is transferred back through the upper short link 48 to the actuating link 62. The resistance force thus transferred by the upper short link 48 to the actuating link 62 tends to pivot the actuating link 62 in the clockwise direction around the pivot axis 64 as viewed in FIG. 2. Such pivoting movement of the actuating link 62 is prevented, however, by the pivot pin 66 that is held in position by the cutoff cam 100.

The resistance force that is transferred to the pivot pin 66 through the actuating link 62 tends to rotate the cutoff cam 100 around the pivot axis 102. The cutoff cam 100 resists such rotation, however, because of the restraining force applied to the cutoff cam 100 by the tension control mechanism. When the cable tie 12 is snugged up tightly against the wires 14, the resistance to further tightening increases substantially. The increased resistance force transferred through the pawl links 40, the upper short link 48, the actuating link 62 and the pivot pin 66 eventually becomes great enough to overcome the force applied to the cutoff cam 100 by the tension control mechanism. When this occurs, the cutoff cam 100 rotates in the counterclockwise direction around the pivot axis 102, thereby allowing the pivot pin 66 to move forwardly out of the notch in the cutoff cam 100. The resistance force developed by the tie tail 18 and transferred to the actuating link 62 causes the actuating link 62 to pivot in the counterclockwise direction around the pivot axis 64 under considerable force. As it does so, the actuating link 62 moves the cutoff link 84, thereby causing it to push the rear end of the blade link 82 down. This pivots the blade link 82 around the pivot axis 88, thereby causing the blade link 82 to raise the blade 80 and thereby cut off the tie tail 18. When the tie tail 18 is cut, it no longer applies a resisting force to the pawl links 40 and the mechanism quickly snaps back to the initial condition shown in FIG. 2.

It will be appreciated that the point at which the cutoff cam 100 rotates to actuate the blade 80 is controlled by the tension developed by the tension control mechanism. In this manner, the tension control mechanism controls the final tension in the installed cable tie 12.

It will also be appreciated that the mechanical advantage provided by the lever effect of the trigger mechanism 24 permits the generation of substantial tension in the tie 12. In particular, it will be appreciated that the upswept curvature of the upper short link 48 reduces the effective length of the lever arm defined between the pivot pin 66 and the ends of the pawl links 40 without reducing the overall length of the trigger 24. This increases the factor by which the force applied to the trigger 24 by the operator is multiplied and applied to the tie tail 18. The tool 10 is thus able to develop significantly higher tie tail tensions, using the same trigger force, than in prior tools. Preferably, a foam rubber or other cushioning cover 114 is disposed over the grip 20 to increase user comfort and enable the user to exert substantial forces on the trigger 24 without discomfort.

Preferably, a hook assembly 140 is provided at the rear end of the tool 10. The hook assembly 140 allows the tool to be hung from a belt during use or from another hook or support during storage. As best seen in FIG. 7, the hook assembly includes a circular swivel 142 that can be mounted to the rear of the tension control knob 26 by means of a screw 144 or other fastener. A hook loop 146 has a pair of opposed, spaced ends that are received in two diametrically opposed holes 148 formed in the swivel 142. The swivel 142 is rotatable around the screw 144, and the hook loop 146 is pivotable from a storage position against the knob 26 to a use position substantially perpendicular to the knob 26. Preferably, the ends of the hook loop 146 are displaced relative to each other when the hook loop 146 is off the swivel 142 so as to develop a frictional retaining force against the swivel that helps keep the hook loop 146 in either the storage of use position.

The Nose Guard Assembly

As noted, the nose guard assembly 30 provides substantial reinforcement to the front end of the tool 10. This, in turn, enables the tool 10 to withstand the substantial compressive forces developed while tensioning a tie 12. The configuration of the nose guard assembly 30 can best be understood by reference to FIGS. 5 and 6.

The nose guard assembly 30 includes a nose guard 116 that substantially surrounds the entirety of the front end of the tool 10. Preferably, the nose guard 116 is formed of a one piece metal casting having a bottom 118, a pair of sides 120 and a top strap 122. The sides 120 and bottom 118 of the nose guard 116 define a hollow interior that substantially conforms in shape to the shape of the forward end of the tool 10 housing. The top strap 122 is of substantially lesser width than the bottom 118 or sides 120 and extends over the forwardmost tip of the tool 10 housing. A gap is left between one end of the top strap 122 and the adjacent side 120 to permit the tie tail 18 to be slid into the tool 10 from the side. A substantially rectangular opening 124 is preferably formed in the bottom 118 to reduce weight and material requirements.

The forwardmost end of the nose guard 116 defines a rectangular space that closely receives the outer and inner nose pieces 32 and 36. The inner nose piece 36 includes a rearwardly extending, substantially horizontal top plate 126 having a groove 128 formed in its undersurface. The groove 128 is dimensioned to receive the upper end of the outer nosepiece 32 therein and helps to support the outer nosepiece 32 against the substantial normal forces that are exerted by head 16 of the tie 12 on the outer nosepiece 32 when the tie is tensioned. A slot 130 between the top plate 126 and the remainder of the inner nose piece 36 provides clearance for the tie tail 18. A rectangular aperture in the face of the inner nose piece 36 provides clearance for the end 90 of the blade link 82.

The outer nose piece 32 comprises a substantially rectangular, planar member dimensioned to be received in the rectangular space defined by the forward end of the nose guard 116. A horizontal slot 134 formed in the outer nose piece 32 provides clearance for the tie tail 18. The channel 86 formed in the rear surface of the outer nose piece 32, together with the forward face of the inner nose piece 36, confines the blade 80 for reciprocating vertical movement between the inner and outer nose pieces. A depression or relief area 136 is also formed in the rear surface of the outer nose piece 32 to provide clearance for the end 90 of the blade link 82.

The horizontal slot 92 formed in the blade 80 receives the end 90 of the blade link 82 to couple the blade 80 for vertical movement with the blade link 82. The upper end of the blade 80 is preferably chamfered and angled as shown to provide the appropriate cutting action when the tie tail 18 is to be cutoff. A pair of screws 138 preferably secure the outer nose piece 32 to the inner nose piece 36. Additional screws or fasteners are used to secure the inner nose piece 36 to the nose guard 116 and to secure the nose guard 116 to the housing of the tool 10.

It will be appreciated that the inherent rigidity and strength of the nose guard 116 substantially increases the ability of the tool 10 to withstand the substantial tensioning forces needed to install metal ties.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

We claim:

1. A tool for installing metal ties comprising:

a pistol-shaped housing including a grip and a barrel portion, an elongate trigger extending downwardly from the barrel portion forwardly of the grip and displaceable toward and away from the grip, a tensioning mechanism in the barrel portion operable to engage the tie and apply tension to the tie in response to movement of the trigger toward the grip, a cutoff mechanism in the barrel portion operable to cut-off the tie when tension applied by the tensioning mechanism reaches a predetermined threshold, and a reinforcing member surrounding at least a portion of the barrel portion to stiffen the barrel portion of the housing and resist compressive forces developed in the barrel portion as the tensioning mechanism tensions the tie.

2. A tool as defined in claim 1 wherein the reinforcing member comprises a unitary rigid structure external to the barrel portion of the housing.

3. A tool as defined in claim 2 wherein the reinforcing member substantially surrounds the forward end of the barrel portion of the housing.

4. A tool as defined in claim 3 wherein the reinforcing member is formed of metal.

5. A tool as defined in claim 4 wherein the reinforcing member comprises a metal casting.

6. A tool as defined in claim 2 wherein the tool includes an outer nose piece supported by the reinforcing member and an inner nose piece behind the outer nose piece.

7. A tool as defined in claim 6 wherein the tool further includes a cutoff blade supported for reciprocating movement between the inner nose piece and the outer nose piece.

8. A tool as defined in claim 2 wherein the reinforcing member includes a gap for permitting insertion of a tie into the tool.

* * * * *